US007442047B1

(12) United States Patent
Schmidgall

(10) Patent No.: US 7,442,047 B1
(45) Date of Patent: Oct. 28, 2008

(54) COMPRESSION CONNECTOR FOR CONNECTING A FLAT FLEXIBLE CIRCUIT TO A PRINTED CIRCUIT BOARD

(75) Inventor: David R. Schmidgall, Wood Dale, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/080,733

(22) Filed: Apr. 4, 2008

Related U.S. Application Data

(60) Provisional application No. 60/963,323, filed on Aug. 3, 2007.

(51) Int. Cl.
*H01R 12/00* (2006.01)

(52) U.S. Cl. ..... 439/67

(58) Field of Classification Search ..... 439/67, 439/329, 493, 495
See application file for complete search history.

(56) References Cited

U.S. PATENT DOCUMENTS 5,211,577 A * 5/1993 Daugherty ..... 439/493
5,676,562 A * 10/1997 Fukuda ..... 439/329
6,007,359 A * 12/1999 Kosmala ..... 439/329
6,846,115 B1 * 1/2005 Shang et al. ..... 385/92

* cited by examiner

*Primary Examiner*—Phuong K Dinh
(74) *Attorney, Agent, or Firm*—Larry I. Golden

(57) ABSTRACT

A compression connector for connecting the conductor pads of a flat flexible cable to the conductor pads of a printed circuit board. The connector includes a carrier plate which carries a hardboard, the flexible circuit and an interposer through the use of extending peg portions extending from one side of the plate. The peg portions extend beyond the interposer for receipt within positioning openings of the printed circuit board to position the flexible circuit and interposer for electrical connection to the conductor pads of the printed circuit board. A cage structure is secured to the printed circuit board having a top wall covering the positioning openings as well as the conductor pads of the printed circuit board. An actuator having a tension spring mounted thereon is slidably carried on the opposite side of the carrier plate. The actuator is movable between a first position corresponding to a disengaged position and a second position corresponding to an engaged position. The extending peg portions may be placed in the positioning openings with the actuator in its first position and the actuator can then be moved to its second position, causing the top wall of the cage structure to engage with and compress the spring and thereby provide compression force against the flexible circuit, interposer and conductor pads of the printed circuit board to effect appropriate mechanical and electrical connections.

18 Claims, 6 Drawing Sheets

COMPRESSION CONNECTOR FOR CONNECTING A FLAT FLEXIBLE CIRCUIT TO A PRINTED CIRCUIT BOARD

FIELD OF THE INVENTION

This invention relates generally to a compression connector for connecting a flat flexible circuit to a printed circuit board.

BACKGROUND OF THE INVENTION

In the field of electronics, there is an increasing need for connections between rigid printed circuit boards and flexible cables such as flat flexible circuits. Since relatively complex circuits are now constructed on flexible materials, their connection to conventional printed circuit boards has become increasingly more important.

Such connections have, oftentimes, been effected by soldering or through the use of fastening hardware, such as screws, to facilitate a secure electrical connection. It is desirable to be able to secure alignment for a proper mechanical and electrical connection and to effect such connection without the need to utilize loose hardware which can easily be lost, mishandled or dropped. Even retained hardware requires proper tightening and subsequent loosening to effect proper electrical connection and subsequent disconnection between the conductor pads of the flexible circuit and the conductor pads of the printed circuit board. These tasks require appropriate tools as well as time in order to properly connect and disconnect the mating components.

BRIEF SUMMARY OF THE INVENTION

An object, therefore, of the invention is to provide an improved connector which does not utilize loose or retained fastening hardware during the connection and disconnection process and which includes alignment means to align the flexible circuit for proper mechanical and electrical connection to the printed circuit board.

In an exemplary embodiment of the invention, a new and improved compression connector is shown for mechanically and electrically connecting the conductor pads of a flat flexible circuit to the conductor pads of a complementary printed circuit board. The connector includes a carrier plate having one side to which a flexible circuit is secured through the use of a pair of extending pegs and having an opposite side which slidably carries an actuator. The actuator is slidably carried by the carrier for movement between a first (disengaged) position and a second (engaged) position. A tension spring is securely mounted to the top side of the actuator at its forward end.

The printed circuit board includes a pair of positioning openings or holes for receiving the extending pegs and also includes a cage structure having a top wall and side walls, with the top wall positioned above the positioning holes and also above the conductor pads on the printed circuit board.

An interposer is positioned against the conductor pads of the flexible circuit and is adapted to extend electrical connection between the conductor pads of the flexible circuit and the conductor pads of the printed circuit board in response to the positioning of the carrier plate with the extending pegs received in the positioning holes, while the actuator is in its first (disengaged) position, and subsequent movement of the actuator to its second (engaged) position. Movement of the actuator to its second position causes the top wall of the cage structure to engage and compress the tension spring which exerts downward force against the conductor pads of the flexible circuit, the conductor terminals of the interposer, and the conductor pads of the printed circuit board.

Other objects, features and advantages of the invention will be apparent from the following detailed description taken in conjunction with the accompanying drawings.

DETAILED DESCRIPTION OF THE INVENTION

Figure 1:
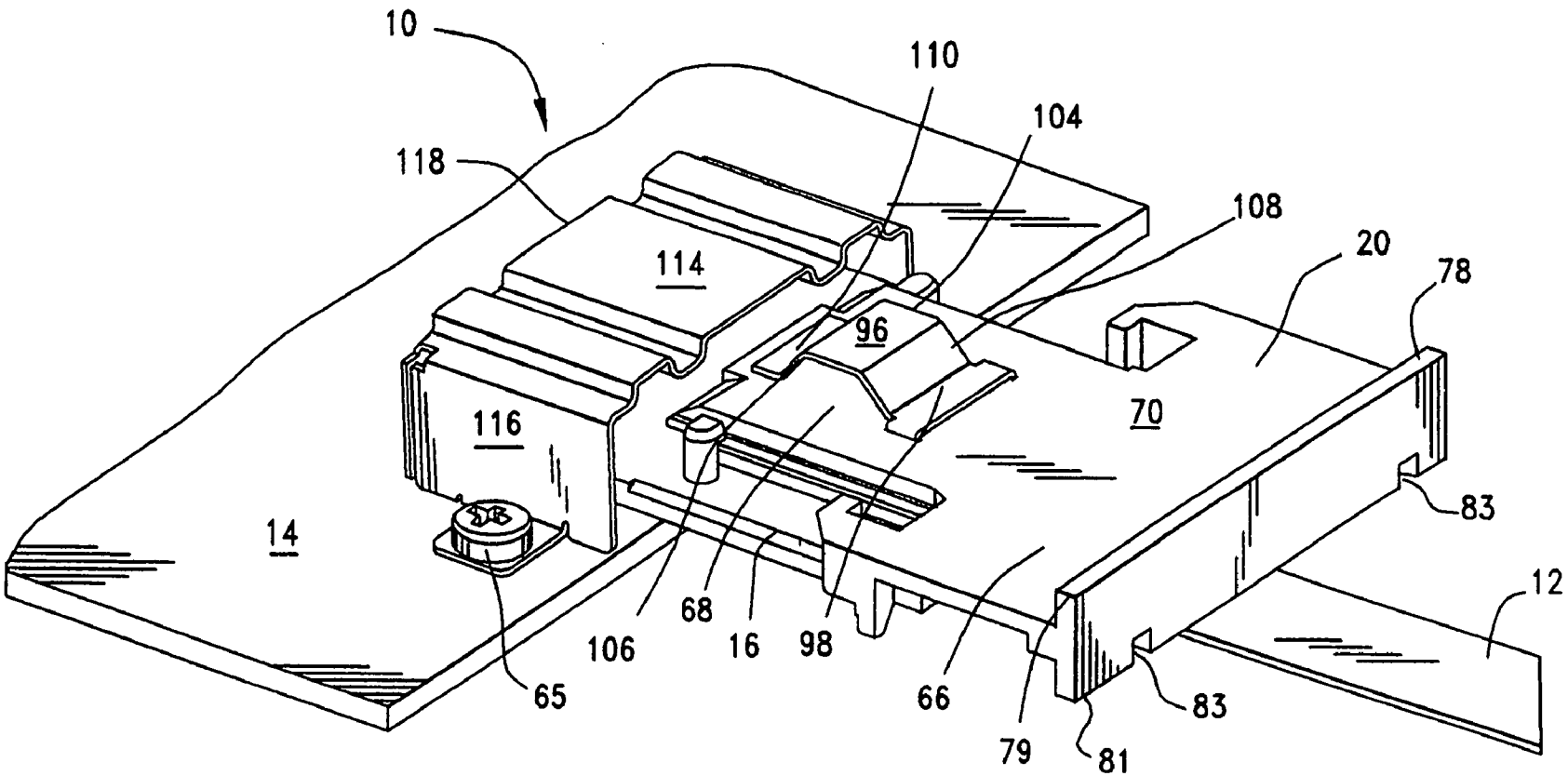
FIG. 1 is a perspective view of the connector assembly.
Figure 6:
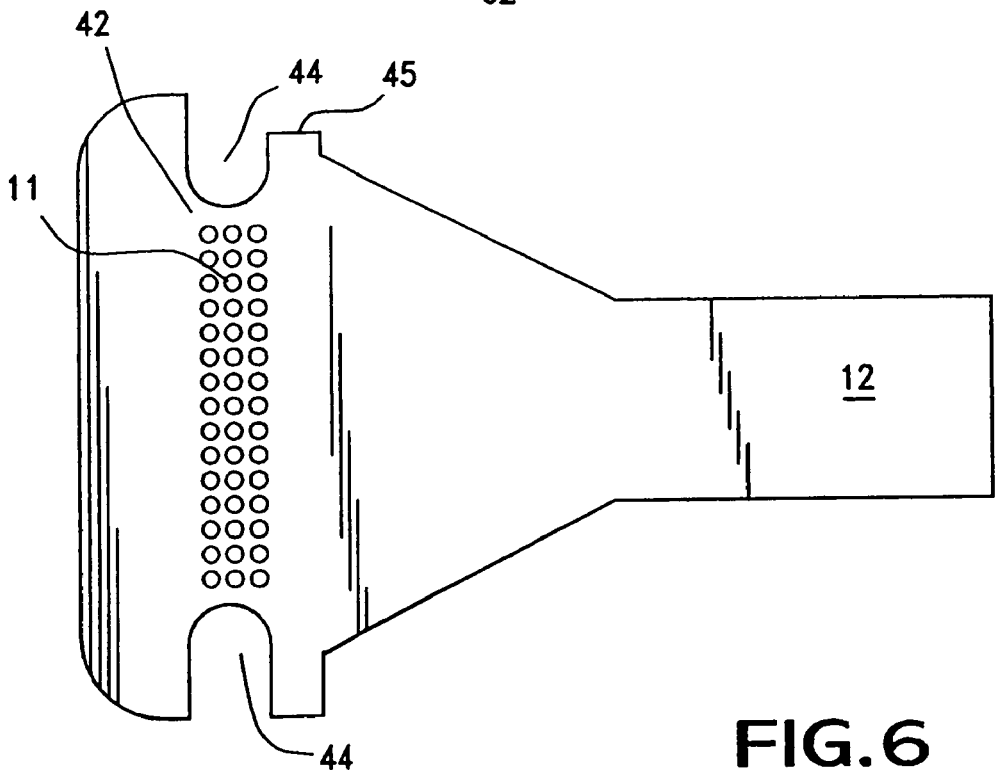
FIG. 6 is a bottom view of the flexible circuit.
Figure 3:
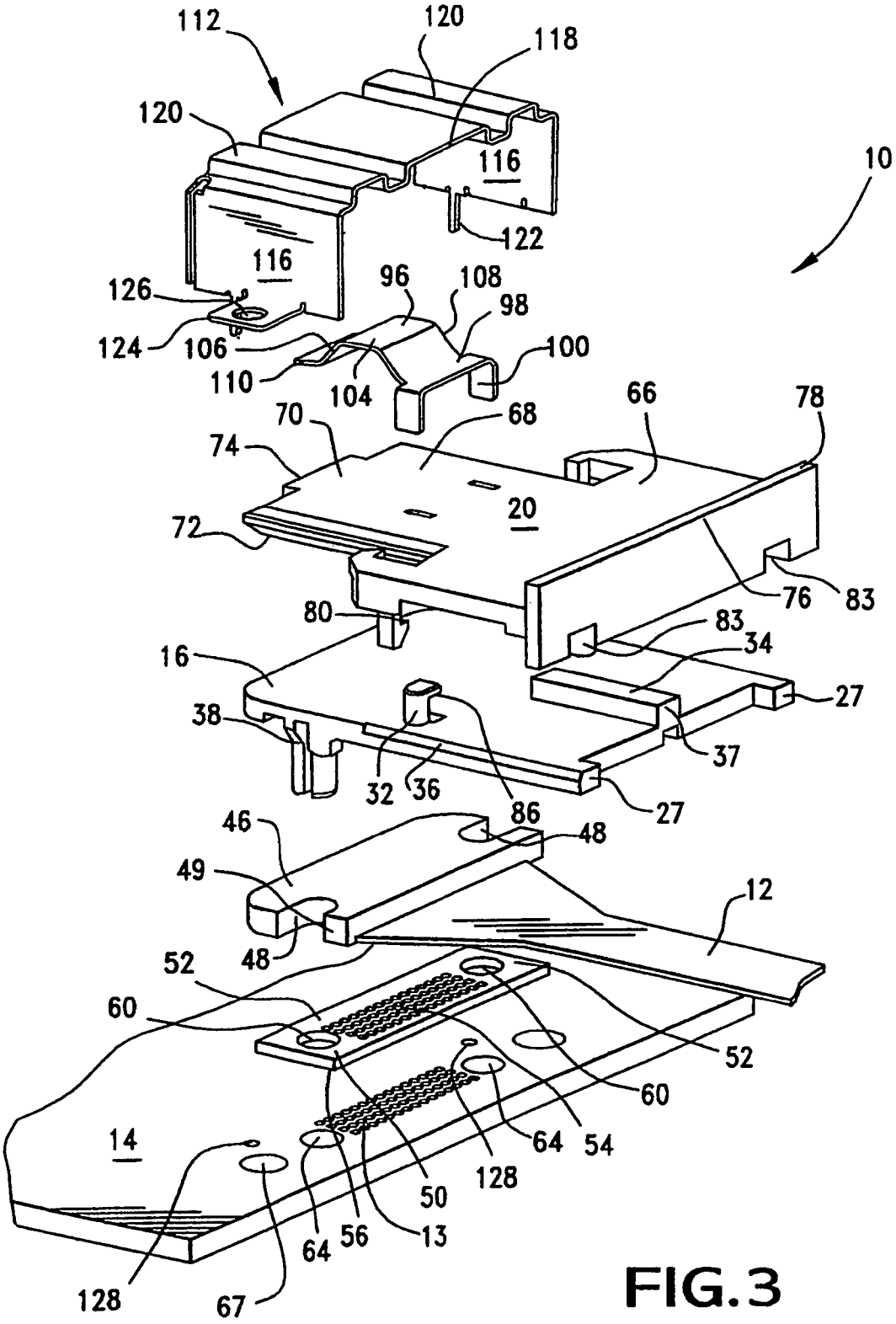
FIG. 3 is an exploded perspective view of the connector assembly.

The compression connector assembly 10 is shown generally in FIG. 1 and also shown in an exploded perspective view in FIG. 3. The connector is shown for the connection of the conductor pads 11, as seen in FIG. 6, of a flat flexible circuit 12 to the conductor pads 13 of a printed circuit board 14, without the use of screws or other loose fasteners, to facilitate a good mechanical and electrical connection.

Figure 4:
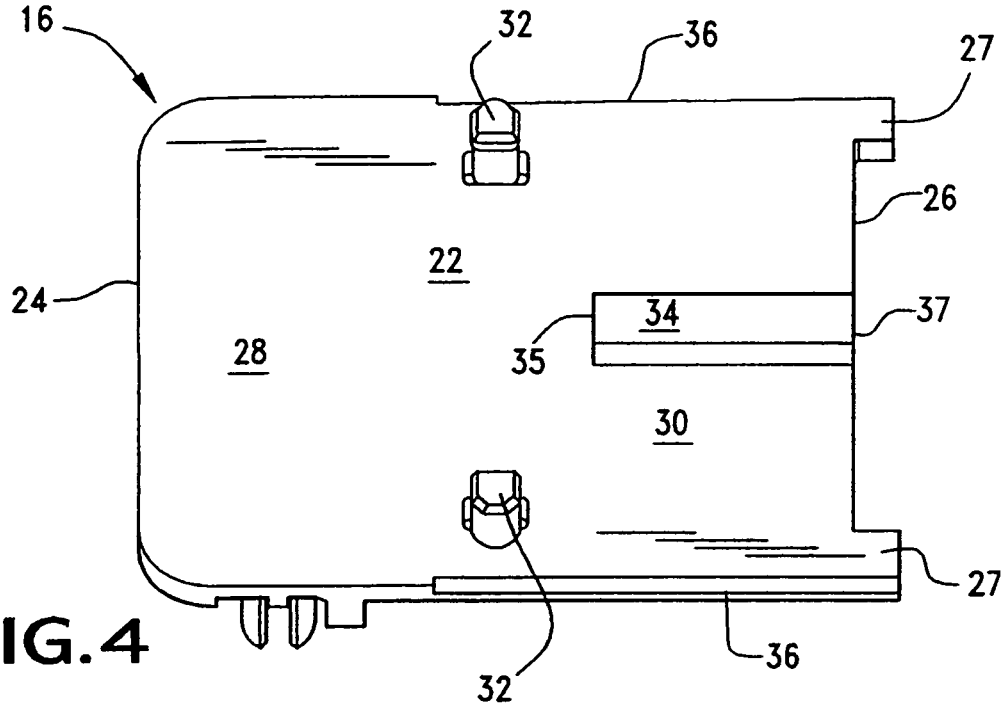
FIG. 4 is a top, rotated view of the carrier plate.
Figure 5:
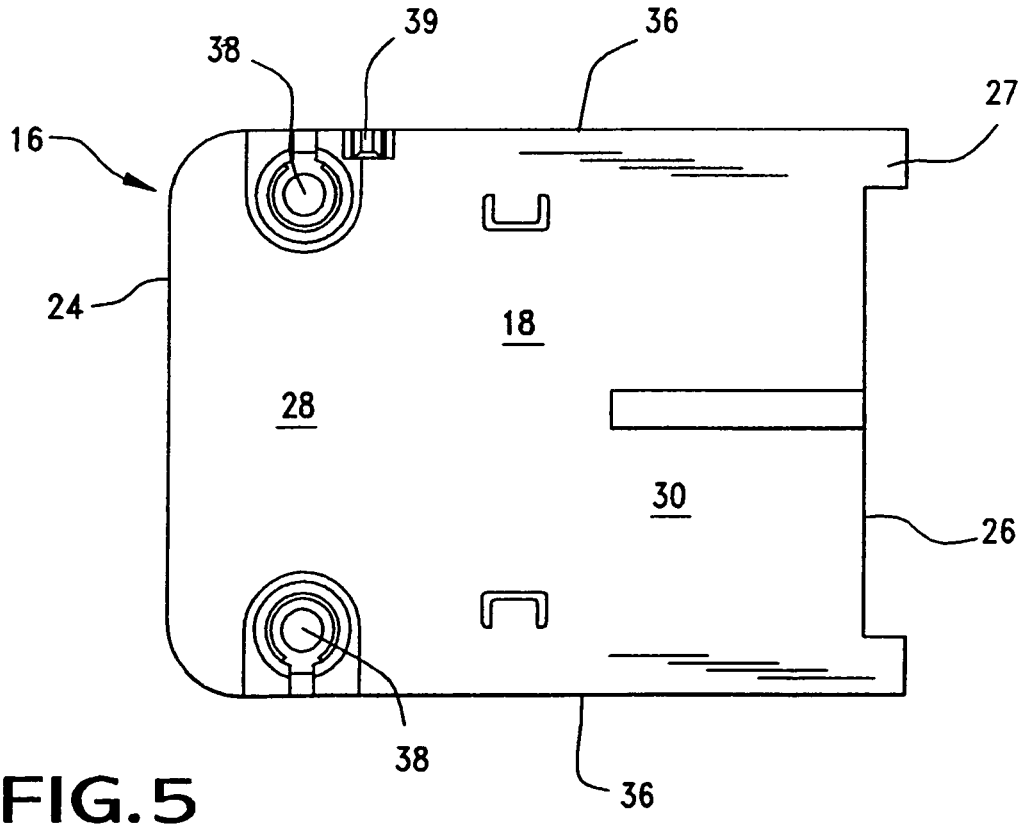
FIG. 5 is a bottom view of the carrier plate.

The connector assembly includes a thin, generally flat, rectangular, molded carrier plate 16 which retains the flexible circuit 12 as hereinafter described in a flat, unwrapped orientation parallel to its bottom surface 18 while carrying a slidable actuator 20 on its top surface 22. The carrier plate, shown also in FIGS. 4 and 5, has a forward end 24 and a rearward end 26 which has extending end tabs 27 and includes portions generally designated as a forward portion 28 and a rearward portion 30. The carrier plate further includes a pair of spaced apart guide pins 32 extending outward from its top surface 22 along a line generally separating the forward portion 28 of the carrier plate from the rearward portion 30 of the carrier plate.

Also protruding from the top surface of the carrier plate is a ridge or bar 34 positioned parallel to and central with respect to opposite side edges 36 of the carrier plate and located at its rearward portion in a perpendicular association with the rearward end 26 of the carrier plate. The bar includes a forward stop surface 35 on the portion extending toward the guide pins and a rearward stop surface 37 at its opposite end flush with the rearward end 26 of the carrier plate. The bar interacts with portions of the actuator as hereinafter described.

Extending outward from the bottom side of the carrier plate on the forward portion 28 adjacent the side edges are a pair of compression pegs 38 and a positioning tab 39. The guide pins 32, bar 34, compression pegs 38 and positioning tab 39 are all integrally molded as part of the carrier plate from polybutadiene terephthalate.

The flexible circuit, as can be seen in FIG. 6, is a generally elongated, flat, rectangular strip 12 having conductor pads 11 on one side of a conductor-terminating flared end 42 along with a pair of opposed slots 44 that are used to align and secure the flexible circuit to the carrier plate within the connector assembly. The slots 44 are positioned at opposite sides of the conductor pads with the openings on opposite side edges of the flexible circuit. One of the slots 44 is framed by a short leg 45 which will be positioned adjacent the positioning tab 39 on the carrier plate 16 to assure proper orientation of the flexible circuit in a position for connection to the printed circuit board, i.e., positioned with the conductor pads 11 facing away from the carrier plate 16.

A generally rectangular hardboard 46, best seen in FIG. 3, which also includes a pair of opposed slots 48 is positioned directly against the bottom side 18 of the carrier plate 16 at the forward end 24 thereof. Again, one of the slots 48 is framed by a short leg 49 which cooperates directly with the positioning tab 39 of the carrier plate to assure proper component orientation. The flexible circuit is positioned, and preferably epoxied, against the hardboard. The slots 44 of the flexible circuit are aligned with the slots 48 of the hardboard, with the conductor pads 11 facing away from the hardboard and with the aligned slots receiving the compression pegs 38. The short leg of the flexible circuit 45 and the short leg of the hardboard 49 are connected and positioned adjacent the positioning tab 39 of the carrier plate. If the short leg of the flexible circuit 45 and short leg of the hardboard 49 are not positioned in proper orientation along the edge 36 having the positioning tab 39, the positioning tab will prevent the hardboard and connected flexible circuit from coplanar engagement with the bottom side 18 of the carrier plate. Proper orientation is thereby assured by having the conductor pads 11 of the flexible circuit 12 facing outward from the carrier plate 16 for electrical connection with the conductor pads 13 of the printed circuit board 14, as hereinafter more fully described.

A generally rectangular shaped interposer 50 is utilized in the assembly and includes a first side 52 having first conductor terminals 54 that provide a mating area for engagement with the conductor pads 11 of the flexible circuit and a second side 56 including second conductor terminals (not shown) that provide a mating area for establishing electrical connection with the conductor pads 13 of the printed circuit board 14. The interposer includes a pair of holes 60 in registration with the respective slots 44 formed in the flexible circuit 12 and the slots 48 in the hardboard 46 for also receiving the compression pegs 38.

The compression pegs 38 extend through the respective registered slots and openings to retain the hardboard, flex circuit and the interposer while also providing an extended peg portion extending beyond the interposer and forming a pair of positioning pegs 62 utilized to properly align the guide plate and connected hardboard, flexible circuit and interposer with the printed circuit board during the connection process. The hardboard 46 and the flexible circuit 12 can be positioned against the carrier plate with the respective compression pegs extending through the respective slots of the flexible circuit and the hardboard. The positioning tab 39 assures proper orientation of the hardboard/flexible circuit assembly as earlier described. The interposer 50 can then be placed against the flexible circuit with the compression pegs 38 extending through the holes 60 of the interposer to retain the interposer, flexible circuit and hardboard against the carrier plate. Because the positioning tab 39 does not extend from the bottom end 18 of the carrier plate beyond the thickness of the hardboard, the interposer may be placed over the compression pegs 38 in any orientation without interference from the positioning tab. The positioning pegs 62 are adapted to be received in a pair of receptacle areas or positioning openings 64 formed in the printed circuit board 14 to position the carrier plate and attached hardboard, flexible circuit and interposer for mechanical and electrical connection with the conductor pads 13 of the printed circuit board as later further discussed.

Figure 7:
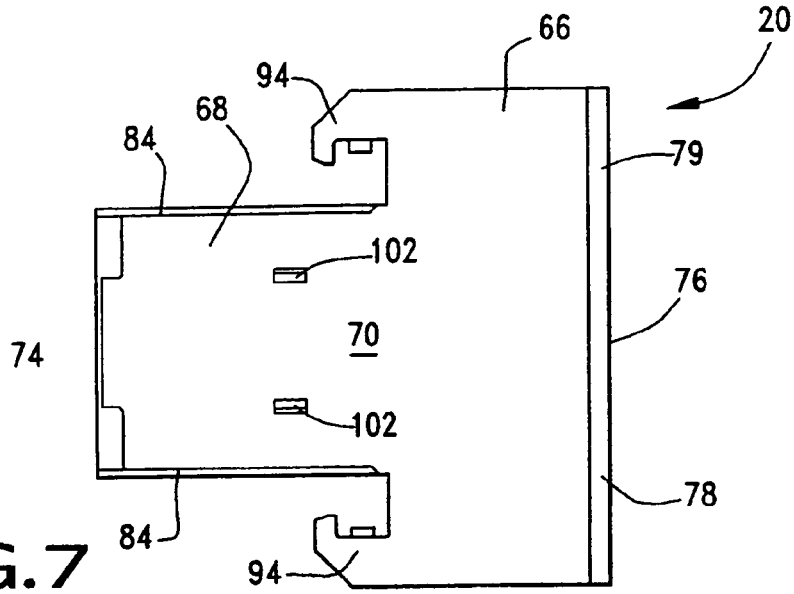
FIG. 7 is a top view of the actuator.
Figure 8:
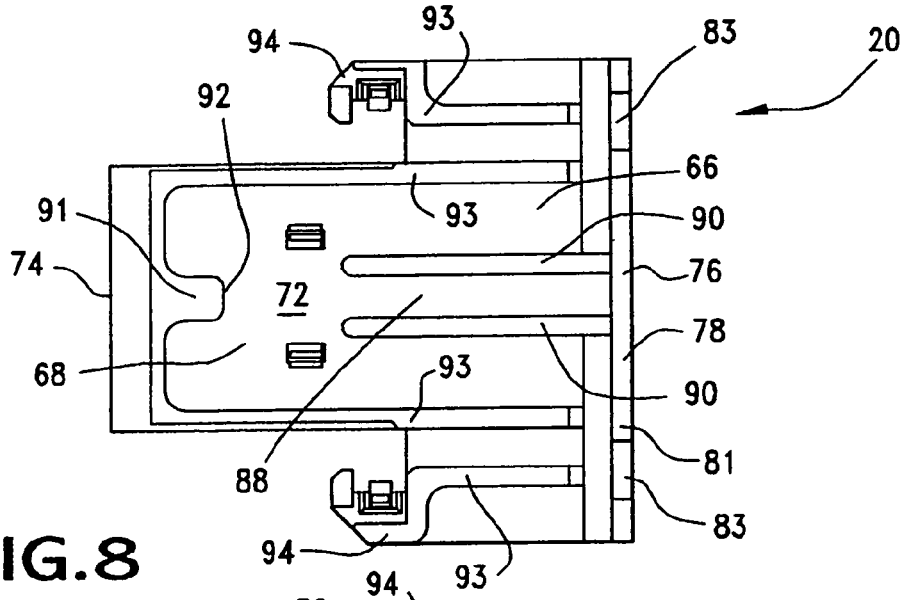
FIG. 8 is a bottom view of the actuator.
Figure 9:
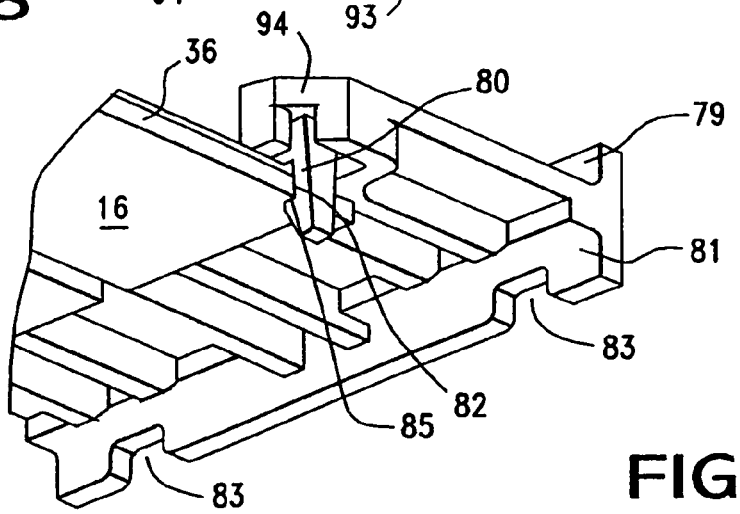
FIG. 9 is a partial bottom perspective view showing cooperation of the latch and channel of the actuator with the carrier plate.

The actuator 20, further shown in FIGS. 7 and 8, includes a rearward main portion 66 and a forward extending portion 68 with a top surface 70 and a bottom surface 72 and a front end 74 and a rear end 76. At the rear end is an actuation bar 78 having an upper ridge 79 and a lower ridge 81. The actuator is partially retained to the carrier plate by a pair of latches 80, each forming a channel 82 to receive one of the respective side edges 36 of the carrier plate 16. The latches extend outward from the bottom side of the actuator as best shown in FIG. 9. The lower ridge 81 of the actuation bar includes a pair of notches 83.

The actuator also includes a pair of parallel extending rails or slide portions 84 along the sides of its forward portion which are engaged by an extending lip 86 at the top of each of the respective guide pins 32.

The actuator further includes an elongated channel 88 formed by a pair of molded channel walls 90 extending perpendicular from the bottom surface 72 and running from the actuation bar 78 in a direction toward the front end 74. The channel walls extend approximately 60% of the distance from the actuation bar toward the front end of the actuator. The bar 34 of the carrier plate is received within the channel 88 for sliding movement between a disengaged or open position and an engaged or closed position. A stop block 91 is molded on the bottom surface of the actuator adjacent the front end in alignment with the elongated channel 88 formed by the channel walls and includes a front stop surface 92 which serves as a stop for the forward stop surface 35 of the bar 34 on the guide plate when the actuator is moved to its fully disengaged position. Additional ribs 93 are provided on the bottom surface of the actuator to provide engagement surfaces that are in contact with the carrier plate and for enhanced structural stability of the actuator.

The rearward main portion 66 of the actuator extends outward from the forward extending portion 68 to include a pair of L-shaped hook portions 94 adjacent the downwardly extending latches 80 to provide structural shrouds for the latches. The forward movement of the actuator is stopped when rearward stop surface 37 of the bar 34 engages the lower ridge 81 of the actuation bar 78. In this position, the extending end tabs 27 of the carrier plate protrude a short distance through the notches 83 in the lower ridge 81 of the actuation bar to provide visual and tactile verification that the actuator is in its fully engaged position. As long as the tabs 27 extend a greater distance than the width of the actuation bar 78, they will protrude from the notches 83. When the actuator is moved back in the rearward direction, the bar 34 slides within the channel 88 from the rearward portion of the actuator toward the forward portion until the bar engages the front stop surface 92 of the stop block 90 when the actuator is in its fully disengaged position. The actuator, including all of its integrally molded features, is formed from polycarbonate plus acrylonitrile butadiene styrene.

Figure 2:
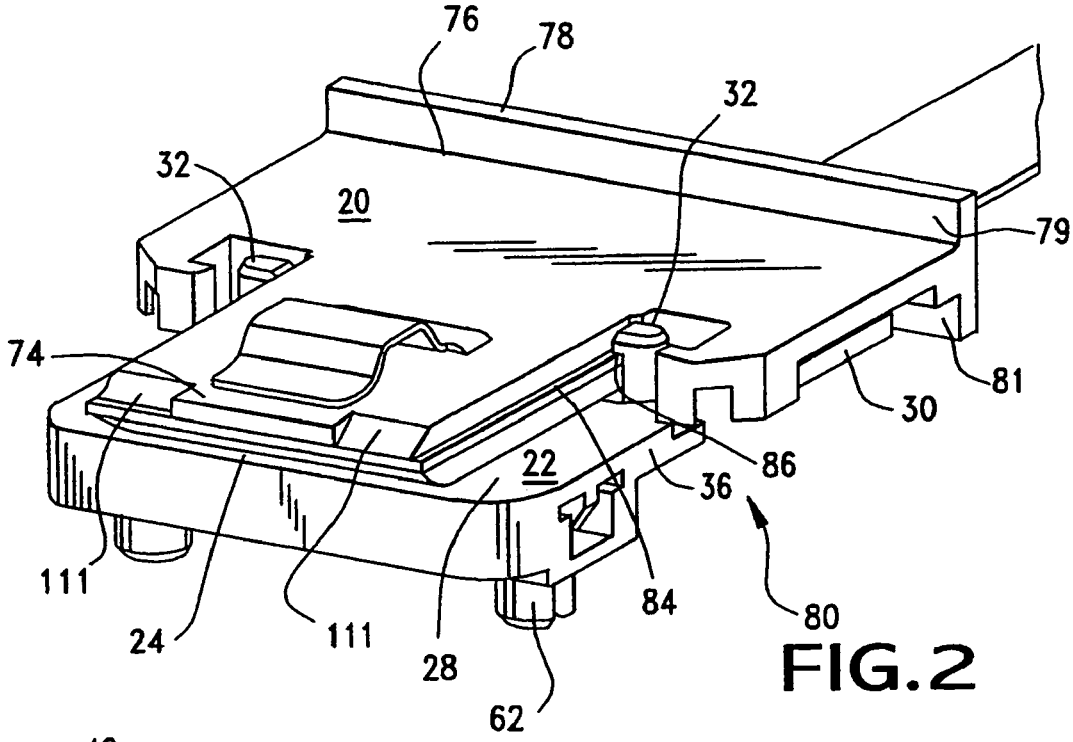
FIG. 2 is a perspective view showing the carrier plate and actuator assemblies of the connector.

The actuator also carries a stainless steel tension spring 96 on its forward extending portion which can be seen in FIGS. 1-3. The spring includes a retaining band 98 with fold-over fastening tabs 100 which are received within a pair of slots 102 formed in the forward extending portion of the actuator. These tabs 100 are folded over against the bottom surface 72 of the actuator to retain the spring in place. The spring further includes a raised central portion having a top spring surface 104, a forward inclined spring surface 106 and a rearward inclined spring surface 108. The spring 96 also has a forward extending lip 110. In an embodiment, for example, where the interposer has sixty (60) contacts, the spring is selected to provide nine (9) lbs of force to effect proper mechanical and electrical connection through the interposer between the contact pads of the flexible circuit and the contact pads of the printed circuit board.

The front end 74 of the actuator includes a pair of inclined side portions 111 as shown in FIG. 2. The central front end of the actuator in front of the lip 110 of the spring does not have an inclined surface, so as to provide a planar extending, flat surface to support the spring while it is being compressed and extended during the engagement process as later described.

As can be seen from FIG. 1 and FIG. 3, the connector assembly includes a stainless steel cage structure 112 secured to the printed circuit board 14 through the use of machine screws 65 which are retained in openings 67 within the printed circuit board. The cage may also be secured to the printed circuit board through the use of either press-fit features and/or solder tails. The cage includes a top wall 114, and a pair of side walls 116 and may also include a back wall (not shown). The top wall 114 includes a main central portion 118 and a pair of side portions 120. Gussets are provided adjacent the central portion to provide additional strength for the cage structure. The cage is secured to the printed circuit board so that the top wall of the cage 114 is above the positioning openings 64 and also over the conductor pads 13 on the printed circuit board. Each of the side walls 116 of the cage includes an integrally extending alignment leg 122 extending downward in coplanar relationship with the respective side walls and also includes an outwardly extending mounting tab 124 having a tab opening 126. The alignment legs 122 are respectively received in alignment holes 128 formed in the printed circuit board 14 which aligns the tab openings 126 with the respective openings 67 in the printed circuit board to facilitate ready securement of the machine screws 65.

Figure 10:
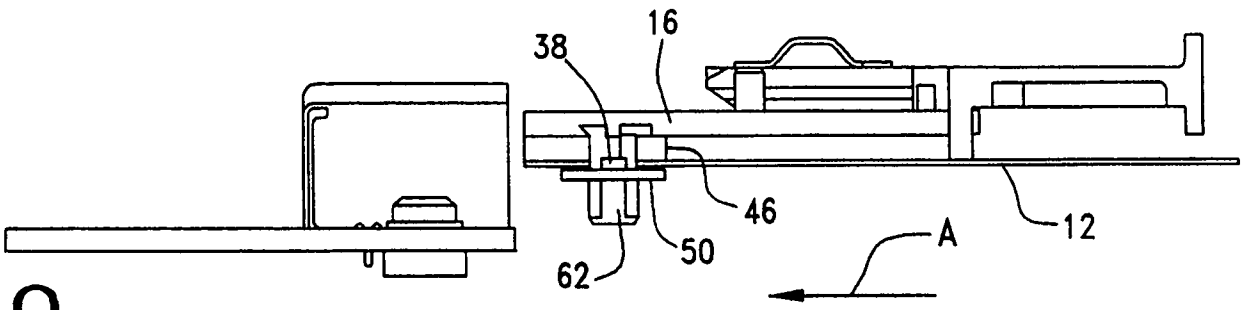
FIG. 10 is a side view showing the connector assembly before positioning within the cage structure with the actuator in its disengaged position.

Turning now to FIG. 10, the connector assembly is shown with the actuator in its fully disengaged or open position, ready to be moved in the direction of arrow A to position the positioning pegs 62 within openings 64 that are provided on the printed circuit board. As further shown in FIG. 9, the actuator 20 cooperates with the carrier plate 16 in multiple ways to assure the proper positioning between the two and to permit appropriate movement of the actuator with respect to the carrier plate. The side edges 36 of the carrier plate are received within the respective channels 82 formed on the latches 80 of the actuator. The bottom lip 85 on the latch retains the carrier plate in position with its top surface 22 against the ribs 93 and also against the channel walls 90 extending from the bottom surface 72 of the actuator 20.

When the actuator is in its fully disengaged position, the forward stop surface 35 of the bar 34 abuts against the stop surface 92 of the stop block 91. With the actuator in this position, a portion of the bar is outside the channel 88 while the balance of the bar continues to be retained within the channel 88.

When the actuator is moved from its disengaged position to an engaged position, the lips of the guide pins 32 move along the rails 84 from the forward end of the actuator toward the rearward end of the actuator until the stop surface 37 of bar 34 engages the lower ridge 81 of the actuation bar 78 at which point the extending end tabs 27 protrude through the notches 83.

Figure 11:
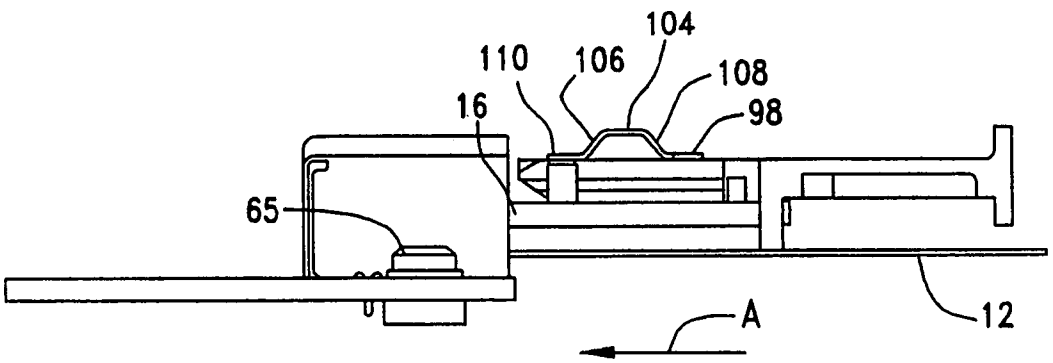
FIG. 11 is a side view showing the connector assembly after positioning within the cage structure with the actuator in its disengaged position.

With the actuator in its fully disengaged position, the carrier plate may be positioned to be inserted within the cage structure as shown in FIG. 10. FIG. 11 shows the carrier plate having been inserted into the cage structure and, though not shown, the positioning pegs 62 are positioned within the positioning openings 64 formed in the printed circuit board.

Once the carrier plate has been properly positioned with the positioning pegs 62 received within the positioning openings 64 as shown in FIG. 11, the actuator may be advanced in the direction of arrow A to effect a pressing engagement of the flexible circuit through the interposer to the printed circuit board which will be caused by the compression of the spring by the top wall of the cage as the actuator is moved to the fully engaged position. Prior to advancing the actuator to its fully engaged position, the carrier plate, hard board, flexible circuit, and interposer are merely loosely positioned against the printed circuit board in a position to effect good electrical contact upon exertion of appropriate compression forces downward on the flexible circuit against the interposer and printed circuit board. The inclined side portions 111 of the actuator along with the forward inclined spring surface 106 facilitate a smooth engagement of the actuator and spring with the top wall of the cage structure. The forward extending lip 110 of the spring is not secured to the top surface of the actuator and therefore, upon engagement of the inclined spring surface by the top wall of the cage during insertion of the actuator within the cage structure, the spring is compressed which exerts a downward force against the forward portion of the top surface of the actuator and also moves the front edge of the extending lip 110 toward the front end 74 of the actuator.

Figure 12:
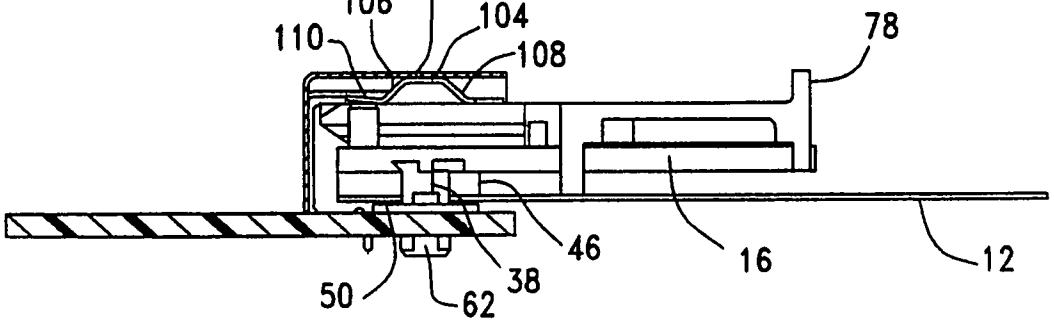
FIG. 12 is a side view showing the connector assembly (without the side wall of the cage) with the actuator in its engaged position within the cage structure.

FIG. 12 shows a side view of the connector assembly without the side wall of the cage structure. This figure shows the positioning pegs received in the positioning openings of the printed circuit board and the actuator fully engaged to its second position to effect proper mechanical and electrical connection of the conductor pads of the flexible circuit through the interposer with the conductor pads of the printed circuit board. As the actuator is moved from the first position shown in FIG. 11 to the second position shown in FIG. 12, the main central portion 118 of the top wall 114 of the cage structure engages the inclined spring surface 106 of the spring 96, which compresses the spring and moves the forward extending lip 110 forward against the flat top forward surface 74 of the actuator 20.

Once fully engaged and connected, the connector can be readily disengaged and disconnected by movement of the actuator 20 from its second position back to its first position which effects disengagement of the spring 96 from the top wall 114 of the cage and permits the carrier plate to be raised to remove the positioning pegs 62 from the positioning openings 64 of the printed circuit board. The connector can thereby be readily disconnected and, if desired, reconnected to secure good mechanical and electrical connection without the need to utilize loose or retained fastening hardware.

While the present invention has been described with reference to certain embodiments, it will be understood by those skilled in the art that various changes and substitutions may be made and equivalents may be used without departing from the spirit and scope of the invention. It is therefore intended that the invention not be limited to the particular embodiment disclosed, but that the invention will include all embodiments falling within the scope of the appended claims.

What is claimed is:

1. A connector for electrically connecting the conductors of a flat flexible circuit to the conductors of a printed circuit board, comprising:

carrier means for carrying said flexible circuit in a fixed position with respect to said carrier means with said conductors of said flexible cable facing outward from one side of said carrier means; said carrier means including a pair of extending peg portions extending from said one side for receipt in a pair of positioning openings formed in said printed circuit board;

an actuator slidably engaged with an opposite side of said carrier means and movable between a first position corresponding to a disengaged position and a second position corresponding to an engaged position;

a tension spring mounted on said actuator;

a cage structure secured to said printed circuit board and having a top wall covering said pair of positioning holes;

said carrier means adapted to properly position said conductors of said flexible circuit for connection with said conductors of said printed circuit board by positioning said extending peg portions within said openings in said printed circuit board while said actuator is in its first position and subsequently moving said actuator to said second position to secure connection;

said spring positioned to engage said top wall to effect compression of said spring in response to movement of said actuator from said first position to said second position while said extending peg portions are positioned within said holes whereby the compression of the spring exerts downward force on said carrier means to effect good electrical connection between said conductors of said flat flexible circuit and said conductors of said printed circuit board.

2. A connector as claimed in claim 1 wherein said carrier means is a generally rectangular plate, said plate including a pair of guide pins extending from said opposite side; said actuator including a forward extending portion having a pair of parallel rails, each guide pin having a lip in sliding engagement with a respective one of said parallel rails.

3. A connector as claimed in claim 1 wherein said actuator includes a pair of slots formed therein; said spring member including a retaining band at one end thereof having a pair of fold-over tabs received within said slots for retention of said spring member to said actuator.

4. A connector as claimed in claim 3 wherein said spring member further includes a raised central portion having a top spring surface, a forward inclined spring surface and a rearward inclined spring surface, said rearward inclined spring surface extending between said top spring surface and said retaining band; said spring member further including a forward extending lip extending forward from said forward inclined spring surface and positioned in a coplanar relationship with said actuator.

5. A connector as claimed in claim 4 wherein said actuator includes an actuator bar having a lower ridge including a pair of notches; said plate including a pair of end tabs extending from a rearward end which are respectively received within said notches in response to movement of said actuator to said second position.

6. A connector as claimed in claim 5 wherein said plate includes a pair of opposite side edges and said actuator includes latch means for slidingly receiving said side edges of said plate with said opposite side of said plate in engagement with a bottom surface of said actuator.

7. A connector for electrically connecting the conductor pads of a flat flexible circuit to the conductor pads of a printed circuit board, comprising:

carrier means for carrying said flexible circuit in a fixed position with respect to said carrier means with said conductor pads of said flexible cable facing outward from one side of said carrier means;

positioning means for positioning said conductor pads of said flexible circuit for connection to the conductor pads of said printed circuit board;

an actuator slidably engaged with an opposite side of said carrier means and movable between a first position corresponding to a disengaged position and a second position corresponding to an engaged position;

a tension spring mounted on said actuator;

a cage structure secured to said printed circuit board and having a top wall covering said conductor pads of said printed circuit board;

said spring positioned to engage said top wall to effect compression of said spring in response to movement of said actuator from said first position to said second position while said conductor pads of said flexible circuit are positioned for connection to the conductor pads of said printed circuit board, whereby the compression of the spring exerts downward force on said carrier means to effect good electrical connection between said conductor pads of said flat flexible circuit and said conductor pads of said printed circuit board.

8. A connector as claimed in claim 7 including an interposer having a first side with a first contact mating area in engagement with said conductor pads of said flexible circuit and having a second side with a second contact mating area for engagement with said conductor pads of said printed circuit board.

9. A connector as claimed in claim 7 wherein said carrier means is a generally rectangular plate and said positioning means includes a pair of spaced apart molded compression pegs extending from said plate and a pair of similarly spaced receptacle areas formed in said printed circuit board on opposite sides of the conductor pads of the printed circuit board for receiving said compression pegs.

10. A connector as claimed in claim 9 wherein said plate includes a pair of opposite side edges and said actuator includes latch means for slidingly receiving said side edges of said plate with a top surface of said plate in engagement with a bottom surface of said actuator.

11. A connector as claimed in claim 10 wherein said actuator includes a forward extending portion having a pair of parallel rails; said plate including a pair of guide pins extending from said top surface of said plate, each guide pin having a lip in sliding engagement with a respective one of said parallel rails.

12. A connector as claimed in claim 11 wherein said actuator includes an actuator bar having a lower ridge including a pair of notches; said plate including a pair of end tabs extending from a rearward end which are respectively received within said notches in response to movement of said actuator to said second position.

13. A connector as claimed in claim 12 wherein said plate includes a bar extending perpendicular to said rearward end on a top surface thereof, said bar having a rearward stop surface in flush alignment with said rearward end and a forward stop surface at its opposite end; said actuator including an elongated channel formed by a pair of molded side walls extending perpendicular from said lower ridge of said actuator bar, said channel extending only a portion of the length of said actuator, a stop block including a stop surface is provided at the forward end of said actuator in alignment with said channel; said bar received within said channel for movement between a first position wherein said rearward stop surface is in engagement with said lower ridge of said actuator bar and a second position wherein said forward stop surface is in engagement with said stop surface of said stop block.

14. A connector for electrically connecting the conductors of a flat flexible circuit to the conductors of a printed circuit board, comprising:

a flexible circuit carrier having a first side carrying said flexible circuit and an opposite side; said flexible circuit including a contact area at one end thereof, said flexible circuit further including a pair of cut-out portions adjacent said contact area;

an interposer having electrical contacts for establishing electrical connection between said flexible circuit and said printed circuit board and including portions defining a pair of openings therethrough; said interposer positioned against said contact area of said flexible circuit in electrical contact therewith, said openings of said interposer in registration with said cut-out portions of said flexible circuit;

a pair of pegs extending from said carrier and retaining said interposer to said flexible circuit; said pegs extending through said cut-out portions in said flexible circuit and through said openings in said interposer and having further extending peg portions extending outward from said interposer and away from said flexible circuit; said printed circuit board including portions defining a pair of mounting holes for receiving said further extending peg portions at locations for properly positioning said interposer for electrical connection to said conductors of said printed circuit board;

an actuator slidably engaged with said carrier and positioned on said opposite side of said carrier; said actuator having a front end and a back end and being movable between an engaged position wherein said front end is in general alignment with said interposer and peg portions and a disengaged position wherein said front end is out of alignment with said interposer and peg portions;

a cage member secured to said printed circuit board having a top wall and side walls and covering said mounting holes; and a spring member mounted on the front end of said actuator and positioned to engage said top wall of said cage member and to compress said flexible circuit against said interposer and said circuit board to facilitate good electrical connection therebetween in response to the positioning of the peg in the mounting hole and subsequent movement of said actuator from said disengaged position to said engaged position.

15. A connector as claimed in claim 14, including a hardboard secured on one side to said flexible circuit and engaged on its other side with said flexible circuit carrier, said hardboard having a pair of cut-out portions aligned with said cut-out portions of said flexible circuit, said flexible circuit carrier including a positioning tab adjacent one of said peg portions, said cut-out portion of said flexible circuit and said cut-out portion of said hardboard receiving said one peg portion each including a short leg positioned adjacent said positioning tab to assure proper orientation of said contact area of said flexible circuit with respect to said flexible circuit carrier.

16. A connector as claimed in claim 14 wherein said actuator includes a pair of slots formed in a forward extending portion; and said spring member having a retaining band at one end thereof including a pair of fold-over tabs received within said slots for retention of said spring member to said actuator.

17. A connector as claimed in claim 16 wherein said spring member further includes a raised central portion having a top spring surface, a forward inclined spring surface and a rearward inclined spring surface, said rearward inclined spring surface extending between said top spring surface and said retaining band; said spring member further including a forward extending lip extending forward from said forward inclined spring surface and positioned in a coplanar relationship with the front end of said actuator.

18. A connector as claimed in claim 17 wherein said actuator includes a pair of inclined side portions at its front end separated by a non-inclined central front end positioned adjacent said forward extending lip of said spring.

* * * * *